US005325963A

United States Patent [19]

Focke et al.

[11] Patent Number: 5,325,963

[45] Date of Patent: Jul. 5, 1994

[54] PACK FOR CIGARETTES OR THE LIKE

[75] Inventors: Heinz Focke, Verden; Harald Gosebruch, Hannover, both of Fed. Rep. of Germany

[73] Assignee: Focke & Co. (GmbH & Co.), Verden, Fed. Rep. of Germany

[21] Appl. No.: 941,799

[22] Filed: Sep. 8, 1992

[30] Foreign Application Priority Data

Sep. 6, 1991 [DE] Fed. Rep. of Germany ..... 4129609

[51] Int. Cl.[5] ..... B65D 85/10

[52] U.S. Cl. ..... 206/268; 206/265

[58] Field of Search ..... 206/260, 268, 264, 265, 206/271, 273, 274

[56] References Cited

U.S. PATENT DOCUMENTS

| | | | |
|---|---|---|---|
| 3,090,541 | 5/1963 | Janda | 206/268 |
| 3,298,590 | 1/1967 | Gray | 206/268 |
| 3,391,780 | 7/1968 | Pasquine et al. | 206/268 |

FOREIGN PATENT DOCUMENTS

| | | | |
|---|---|---|---|
| 942424 | 11/1963 | United Kingdom | 206/265 |

*Primary Examiner*—William I. Price

*Attorney, Agent, or Firm*—Sughrue, Mion, Zinn, Macpeak & Seas

[57] ABSTRACT

Disclosed is a pack for cigarettes or the like. The best known pack types for cigarettes, in particular hinge lid pack and soft cup, both have their advantages and disadvantages. The upper portion (top part 15) of the present pack is in the form of a hinge lid pack and the lower portion (bottom part 16) is in the form of a soft cup pack. As a result, the pack can be handled like a hinge lid pack but requires a smaller expenditure of material. This pack type can also be equipped with a collar which is integrally connected to a blank for the top part (15) which is in the form of a hinge lid pack. The bottom part (16) may also form part of an overall outer wrapper (outer wrapping).

9 Claims, 5 Drawing Sheets

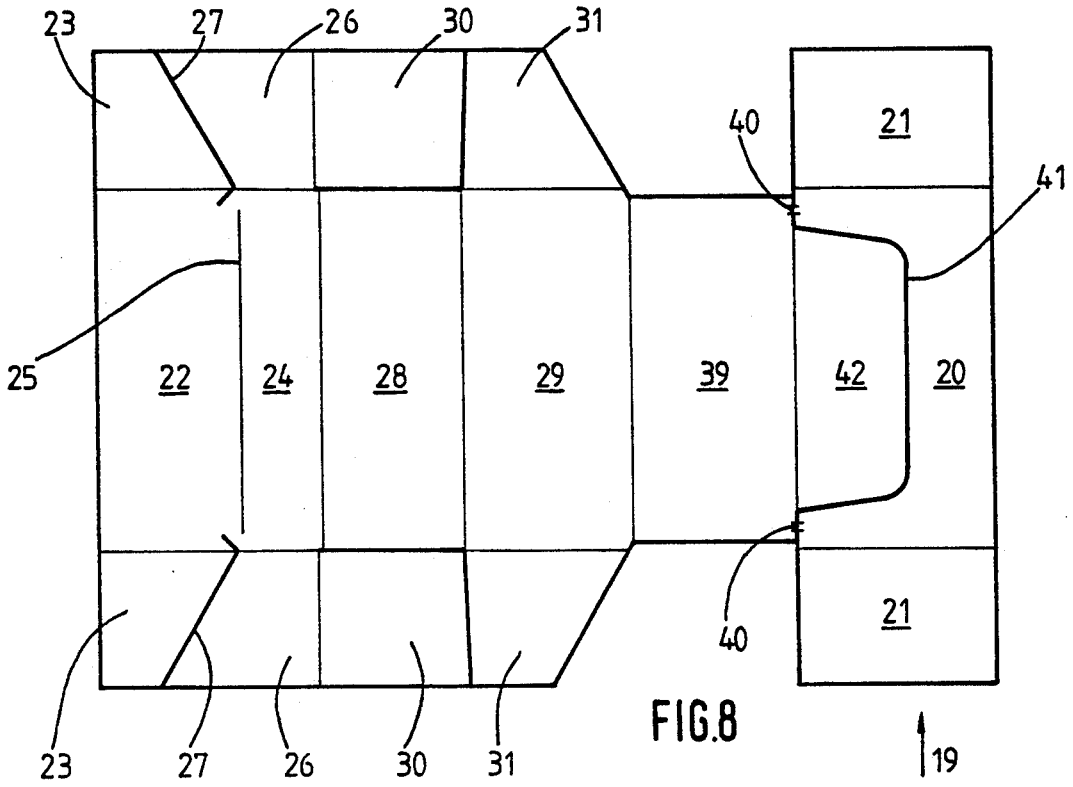
FIG.8
FIG.6
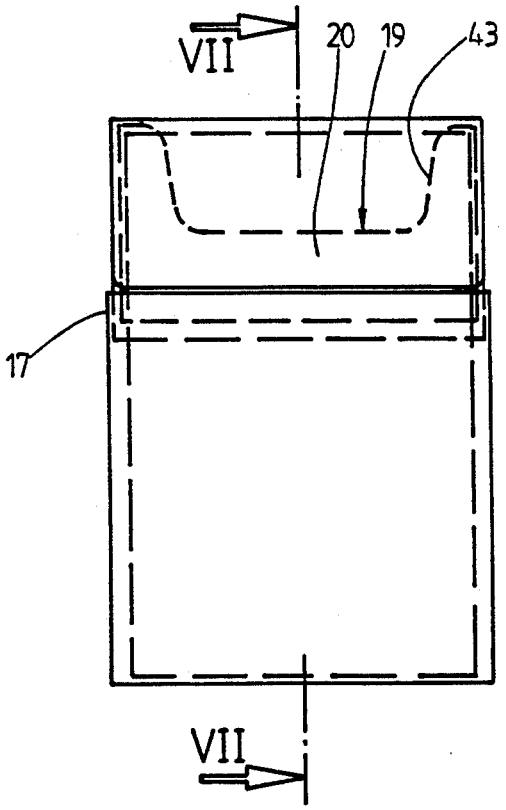
FIG.7
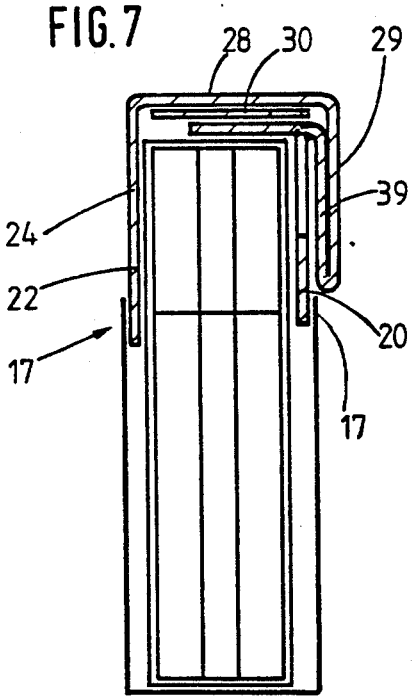

PACK FOR CIGARETTES OR THE LIKE

BACKGROUND OF THE INVENTION

The invention relates to a pack for cigarettes or the like which are packed in an inner wrapper made of tin foil, paper or a foil.

For packaging cigarettes, two types of cigarette packs are most commonly used world-wide. These are, on the one hand, hinge lid packs and, on the other hand, soft (cup) packs. The former pack is formed from thin cardboard. A hinged lid is pivotably connected to a pack part via a hinge connection. The cigarettes, which are in the form of a formatted cigarette group, are usually surrounded by an inner wrapper made of tin foil or paper.

This type of pack also comprises a collar which is inserted into the pack part in the region of a front panel and narrow side panels and which partially projects from the pack part. To improve aroma-preservation, the hinge lid pack is provided with an outer foil wrapper which must be removed before cigarettes are extracted for the first time.

In soft packs, the cigarette group is also packed in an inner wrapper. The actual pack is formed from a paper blank which is folded in a cup-like manner, such that the cigarette group with the outer wrapper partially projects from the cup which is open at the top.

The hinge lid pack is popular particularly because it is easy to handle. On the one hand, this pack is dimensionally stable and, on the other hand, the hinged lid facilitates the extraction of cigarettes. When the pack is closed, the cigarettes left inside the pack are well protected against mechanical and other influences. A drawback of the hinge lid pack is a considerable expenditure of material.

SUMMARY OF THE INVENTION

The soft pack, on the other hand, can be produced at lower cost. A drawback is its unsatisfactory stability. Besides, it is undesirable that the pack can not be closed again once it has been opened.

The invention is based on the object to propose a novel type of pack for cigarettes and similar products which, on the one hand, has a good stability and offers good protection for the cigarettes and, on the other hand, is cheap to manufacture in terms of expenditure of material.

To attain this object, the pack according to the invention is characterized in that a top part is in the form of a hinge lid pack with a hinged lid, and a bottom part is in the form of a soft pack, and in that top part and bottom part are connected to one another by means of adhesive bonding, sealing or the like.

In the pack according to the invention, only a top part is made of thin cardboard. This top part is designed like a hinge lid pack, i.e. with a hinged lid which is attached in a pivotable manner. The bottom part, on the other hand, is formed from a relatively thin packaging material, for example paper. The structural design corresponds to that of a soft pack. The top part and bottom part are durably connected to one another.

As a result of the relatively rigid top part, the pack which is formed in this manner has a favourable stability and can be handled like a hinge lid pack. The use of thin packaging material for the bottom part ensures a cheap production.

The pack according to the invention is preferably equipped with a collar which can be attached inside the pack in the form of a separate blank. Alternatively, the collar may be integrally connected to a blank for the top part, in particular such that the collar is severed from the hinged lid or the hinged lid is severed from the collar when the pack is opened. This arrangement and design of the collar is also of advantage for the manufacture of hinge lid packs which are completely formed from thin cardboard. The advantage is that the hinge lid pack, including the collar, can be formed from a single integral blank. The collar which is joined to the blank for the hinge lid pack is located in such a position that it is automatically moved into its correct position in the pack when the blank for forming the hinge lid pack is folded.

It is another proposal of the invention that the bottom part at the same time forms the outer wrapper of the pack which also entirely surrounds the top part and which is connected to the lower free edge of the top part.

BRIEF DESCRIPTION OF THE DRAWINGS

Exemplary embodiments of the invention will be described below in detail with reference to the drawings, in which:

FIG. 6 shows a front view of another embodiment of the pack, FIG. 7 shows a vertical section of the pack according to FIG. 6, taken along line VII—VII, FIG. 8 shows an unfolded blank for a top part of the pack according to FIGS. 6 and 7.

DESCRIPTION OF PREFERRED EMBODIMENTS

Figure 3:
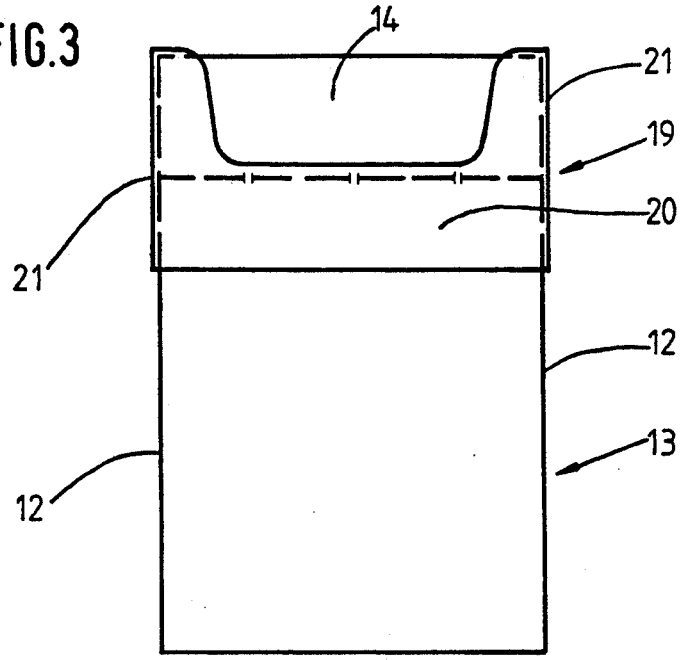
FIG. 3 shows a front view of a portion of the pack according to FIGS. 1 and 2, in particular a cigarette block with a collar blank.
Figure 1:
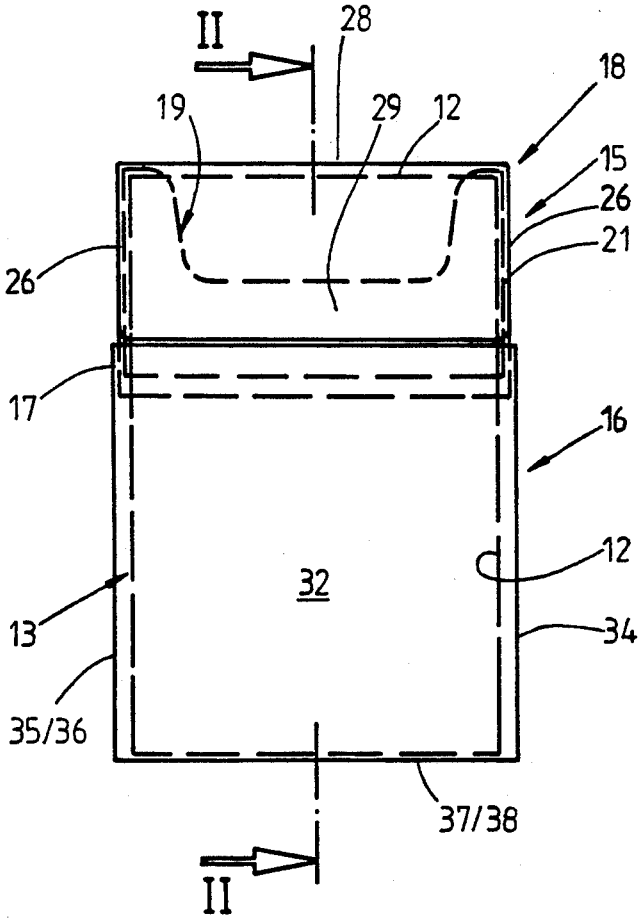
FIG. 1 shows a front view of a first embodiment of a (cigarette) pack.
Figure 2:
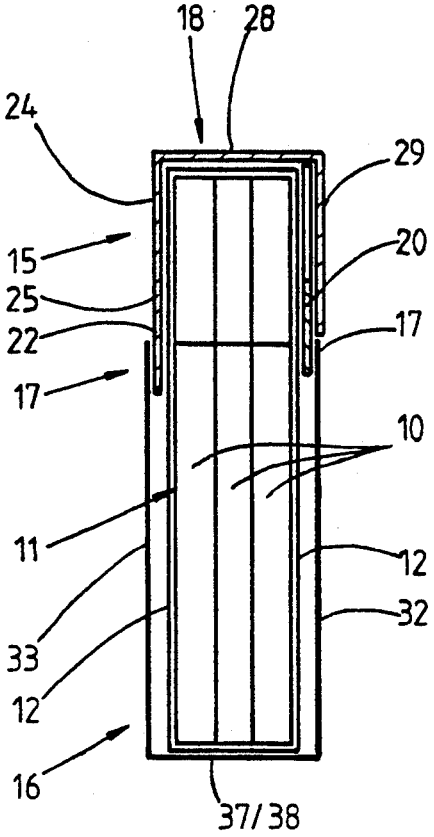
FIG. 2 shows a vertical section of the pack according to FIG. 1, taken along line II—II.

The illustrated embodiments of the packs have a cuboid design and serve for housing cigarettes 10. Like in conventional cigarette packs, a cigarette group 11 is surrounded by an inner wrapper 12 made of tin foil, paper or a foil. The cigarette group 11 with the inner wrapper 12 forms a cigarette block 13 which constitutes the contents of the pack. The front side of the top portion of the inner wrapper 12 is conventionally provided with a flap 14 which can be torn off to expose part of the cigarettes 10 for extraction.

The pack comprises a top part 15 and a bottom part 16. In the illustrated embodiments, the dimensions have been selected such that the bottom part 16 is slightly greater or higher than the top part 15. A connecting strip 17 of top part 15 and bottom part 16 extends all around the pack slightly above an (imaginary) central cross plane of the pack.

Top part 15 and bottom part 16 are made of different packaging materials and have a different design. The top part 15 is designed like a hinge lid pack. The bottom part 16 corresponds to a portion of a soft pack.

The top part 15 is made of (thin) cardboard. A hinged lid 18 is designed like the lid of a hinge lid pack. Additionally, there is disposed a collar 19 with collar front panel 20 and collar side panels 21. In this embodiment, the collar is formed from a separate blank. In the embodiment according to FIGS. 1 to 5, the collar is placed in its correct position on the previously completed cigarette block 13 (FIG. 3) and is then packed together with the cigarette block.

Figure 4:
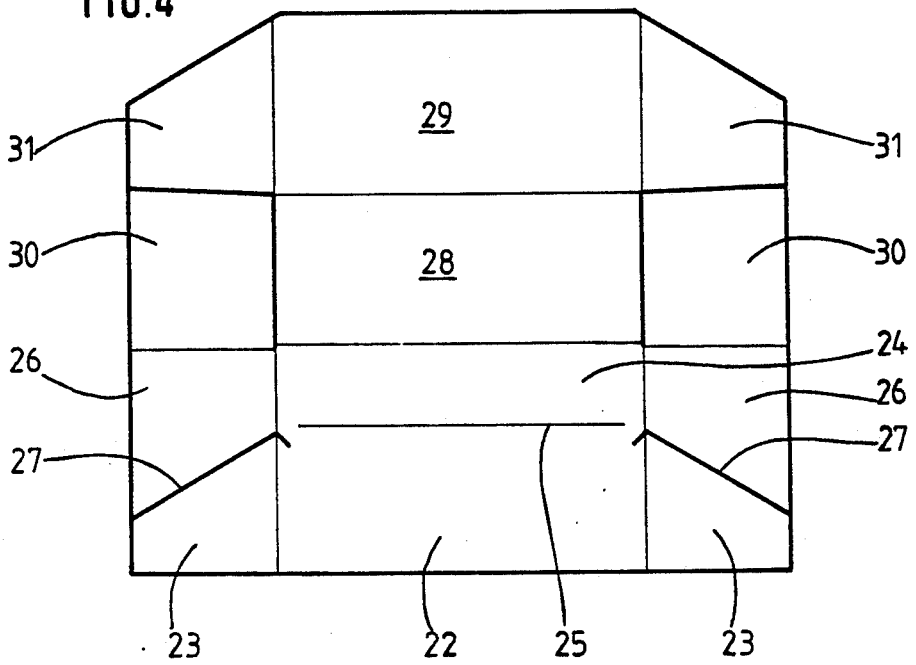
FIG. 4 shows an unfolded part blank for a top part of the pack according to FIG. 1.
Figure 5:
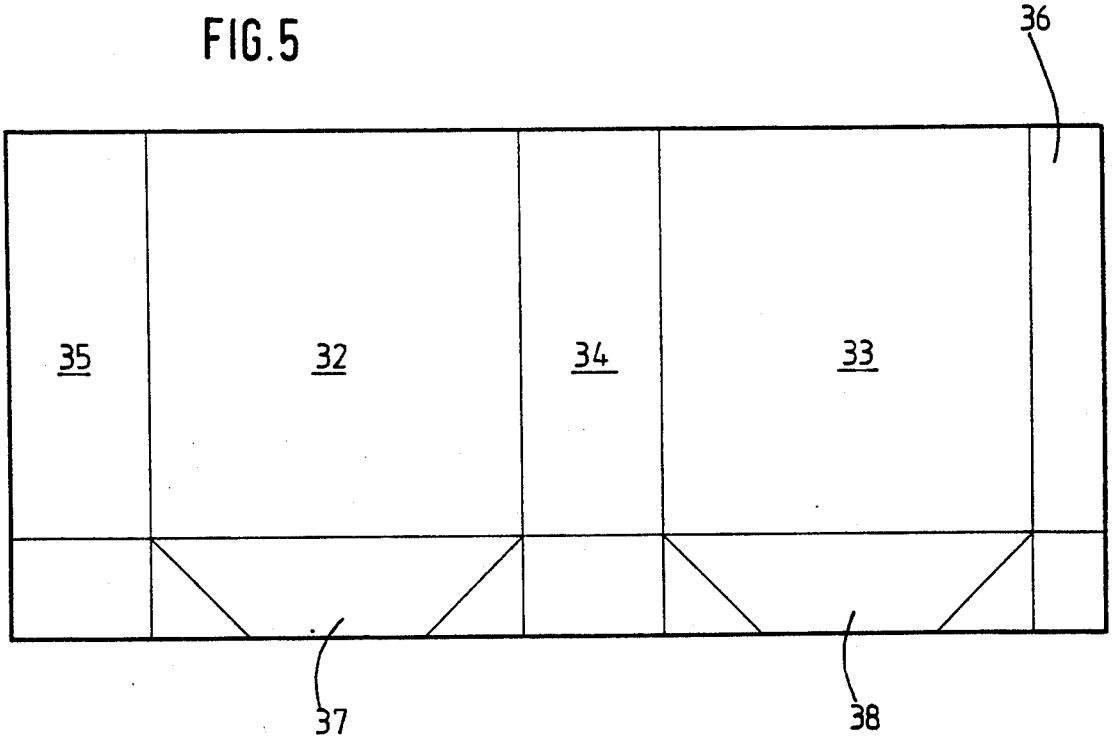
FIG. 5 shows an unfolded b lank for a bottom part of the pack according to FIGS. 1 and 2.

Top part 15 and bottom part 16 are each formed from separate single-piece blanks. The unfolded blank for the top part 15 is shown in FIG. 4 and the unfolded blank for the bottom part 16 is shown in FIG. 5. As illustrated, the top part comprises a rear panel 22 with a small height. Side tabs 23 for forming side panels of the top part 15 are located at the sides of the rear panel 22. The other parts of the blank according to FIG. 4 form the hinged lid 18. A rear lid panel 24 is connected to the rear panel 22 via a hinge line 25. Lid side tabs 26 are arranged at the sides of the rear lid panel. The side tabs 23 and the lid side tabs 26 are separated from one another by an inclined cut 27 which is usually disposed in hinge lid packs.

The rear lid panel 24 is adjoined by a top lid panel 28 which is adjoined by a front lid panel 29. Corner tabs 30 are located at the sides in the region of the top lid panel 28. In the completed pack, these corner tabs 30 rest against the inner side of the top lid panel 28. Trapezoidal outer lid side tabs 31 are connected to the front lid panel 29 and form, together with the lid side tabs 26, side panels of the hinged lid 18. The lid side tabs 26, on the one hand, and 31, on the other hand, are adhesively connected to one another.

In the present embodiment, the top part 15 does not have a front panel. The function of the front panel is taken over by the collar 19 or the collar front panel 20. The collar side panels 21 are connected to the side tabs 23, such that the top part 15 and the collar 19 form a unit. In the closed position of the pack, an (upper) portion of the collar 19 is surrounded by the hinged lid 18 in the conventional manner.

The blank (FIG. 5) for the bottom part 16 may, for example, be made from paper and has a rectangular shape. The blank forms a front panel 32, a rear panel 33 and a side panel 34 which is located between front and rear panel. An opposite side panel is formed from a side tab 35 on the edge of the blank. The side tab 35 is adhesively connected to a connecting strip 36 which is located on the opposite side of the blank. A bottom panel is formed from bottom tabs 37, 38 which are folded envelope-like. These bottom tabs are glued to one another. As a result, a cup-like bottom part 16 is formed.

Top part 15 and bottom part 16 are adhesively connected to one another in the region of the connecting strip 17. In the region of the connecting strip 17, an upper free edge of the bottom part 16 covers the lower free edge of the top part 15 or the collar (collar front panel 20). The dimensions are selected such that a free lower edge of the front lid panel 29 confronts an upper free edge of the front panel 32 of the bottom part 16. In the closed position, the edges abut. The principle of design of the embodiment of the pack according to FIGS. 6 to 8 corresponds to the design of the afore described exemplary embodiment. A special feature is that the collar 19 is integrally connected to the cardboard blank for the top part 15 (FIG. 8). Accordingly, the top part 15 and the collar 19 form a common single-piece blank.

For this purpose, a folding tab adjoins a free outer edge of the front lid panel 29, in particular an inner lid tab 39. In the ready-folded pack, this inner lid tab 39 is folded against the inner side of the front lid panel 29 and is connected thereto, expediently by adhesive bonding (FIG. 7).

In the present exemplary embodiment, the blank for the collar 19 is connected to the inner lid tab 39, in particular in a readily severable manner. The connection is in this case therefore only formed from residual connections 40, in particular connecting webs formed from the material of the blank, which are located at, on the one hand, the lateral edge portions of the inner lid tab 39 and, on the other hand, the lateral edge portions of the collar front panel 20. In the present example, a narrow web-like residual connection 40 of the packaging material is formed on each side. Apart from these connections, the blank of the collar 19 is separated from the blank of the top part 15 by means of a punch cut 41.

In the present exemplary embodiment, the side of the inner lid tab 39 which faces the collar 19 is adjoined by a tongue-shaped folding tab 42. In the ready-folded pack, this folding tab 42 rests against the inner side of the top lid panel 28 or the corner tabs 30 of the hinged lid 28. The contour of the folding tab 42 corresponds to a cutout 43 in the collar front panel 20 which is usually provided in hinge lid packs.

In the ready-folded pack according to FIGS. 6 to 8, the connection between the blank for the top part 15 and the collar 19 is, first of all, maintained. When the pack is put into use, i.e. when the hinged lid 18 is opened, the residual connections 40 are severed, so that the upper portion of the pack corresponds to a conventional hinge lid pack.

Figure 9:
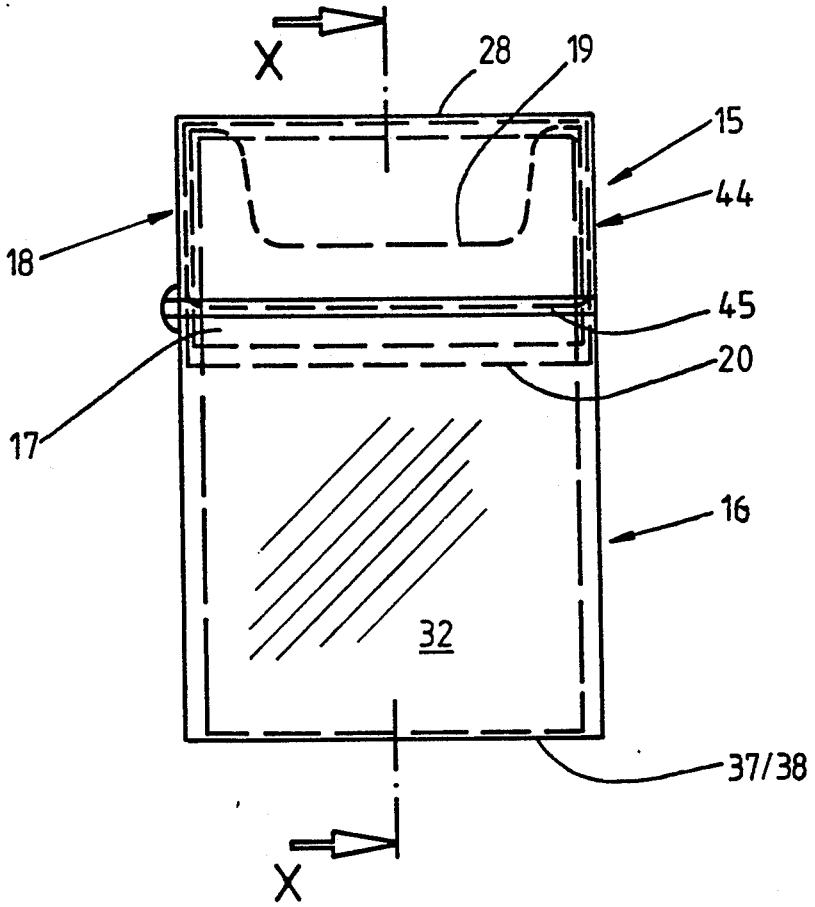
FIG. 9 shows a front view of a third embodiment of the pack.
Figure 10:
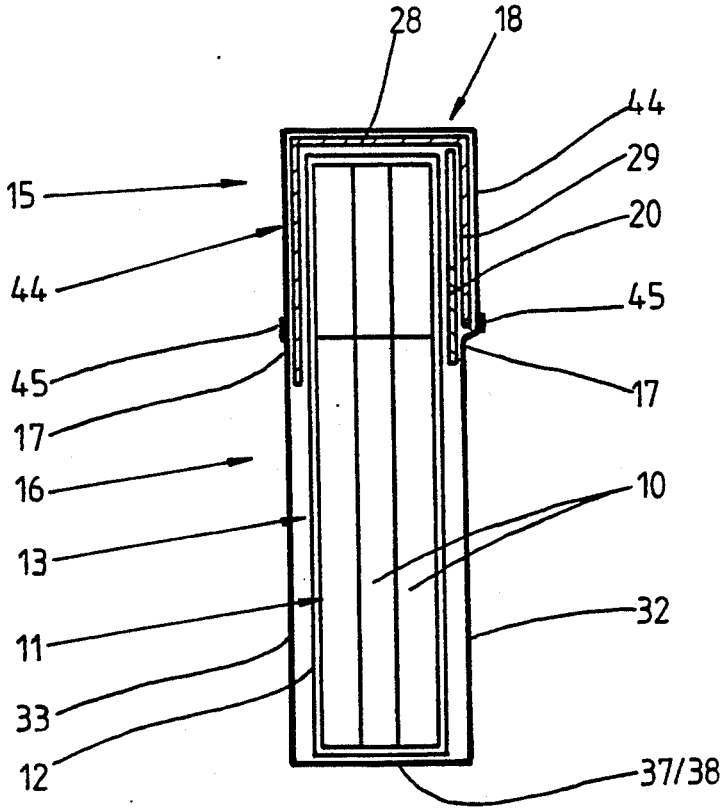
FIG. 10 shows a vertical section of the pack according to FIG. 9, taken a long line X—X.

The pack according to FIGS. 9 and 10 also corresponds to the above described principle of design. The top part 15 can be designed in the manner described with respect to FIGS. 1 to 5 or according to FIGS. 6 to 8. The special feature of the exemplary embodiment according to FIGS. 9 and 10 is that the bottom part 16 of the pack which is formed from a thin flexible packaging material wraps up the entire pack. The blank for the bottom part 16 is extended beyond the connecting strip 17 towards the top and completely covers the outside of the top part 15, including the hinged lid 18. With this embodiment, it is advisable to form the bottom part 16 and a cap 44 which adjoins the bottom part in the region of the top part 15 from a foil, for example a plastic foil. This foil forms the bottom part 16 in the lower part of the pack and an aroma-preserving wrapper in the region of the top part 15. As a result, the entire pack is wrapped in a continuous single-piece outer blank.

To open the pack for the first time, the upper portion of the outer wrapper is severed, i.e. the cap 44 is severed from the bottom part 16. This leaves a pack which corresponds to that of FIGS. 1 to 5 or of FIGS. 6 to 8. For this purpose, the remaining portion of the outer wrapper, i.e. the bottom part 16, is connected to the top part 15 in the described manner along a connecting strip 17 by means of adhesive bonding or sealing.

To sever the cap 44, a conventional tear-off strip 45 or a tear-off thread is arranged at the height of the connecting strip 17. The cap 44 is severed by tearing off this tear-off strip and can then be pulled off the top part 15 of the pack. For this purpose, the connecting strip 17 is arranged below the tear-off strip 45.

Figure 11:
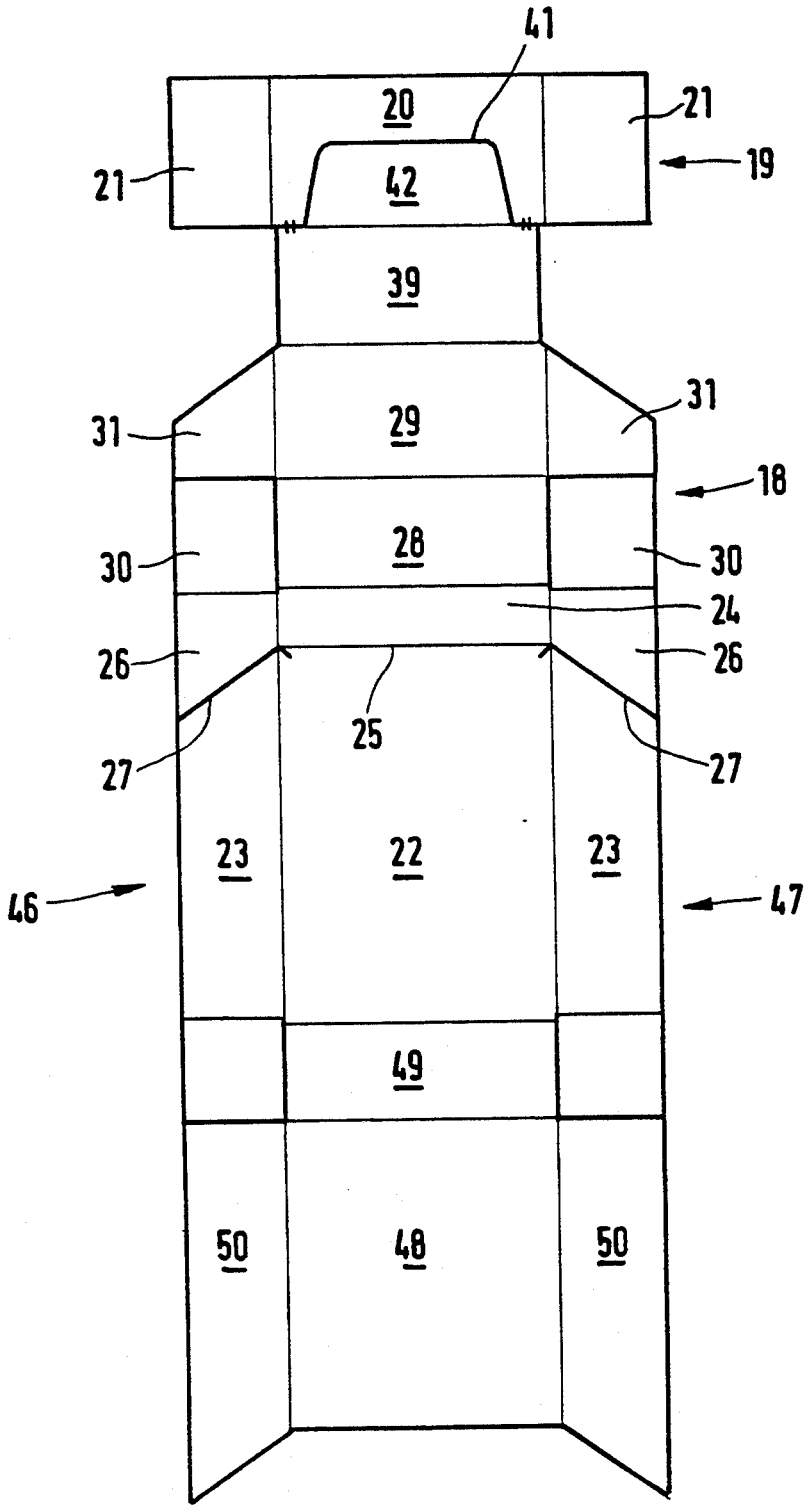
FIG. 11 shows a single-piece blank made of thin cardboard for a hinge lid pack.

The design of a hinge lid pack according to FIGS. 6 to 8 can also be advantageously applied to a hinge lid pack which is entirely made from cardboard. FIG. 11 shows a single-piece blank 46 made of thin cardboard. Apart from the design of the hinged lid 18 and the collar 19, this blank has a conventional structure. In particular, the blank comprises portions for, on the one hand, a pack part 47 and, on the other hand, the hinged lid 18. In addition to the rear panel 22 and the side tabs 23, the pack part 47 also comprises a front panel 48 and a bottom panel 49. Further side tabs 50 form, together with the side tabs 23, side panels of the pack part 47.

The blank portions which form the hinged lid 18 are designed like those of the example of FIG. 8. In the completed hinge lid pack which is made from a blank 46, the upper portion, i.e. the lid, is designed according to FIGS. 6 and 7. The collar 19 partly sits inside the pack part 47 with its collar front panel 20 and the collar side panels 21, which means that the collar 19 rests against the inner side of the front panel 48 and the side tabs 23.

Such a blank 46 can be manufactured with a smaller expenditure of material. Moreover, the pack is technically easy to manufacture. In the course of the folding steps, the collar 19 automatically reaches its correct position in the pack. The additional folding tab 42 on the inner side of the top lid panel 28 increases the rigidity in the region of the hinged lid 18. In the folding process, the collar 19 is connected to the inner side of the pack part 47 in the usual way by means of glue spots.

What is claimed is:

1. A pack for cigarettes (10) which are packed in an inner wrapper (12), wherein:

said pack comprises a top part (15) designed as a hinge-lid pack, and a bottom part (16) designed as a soft pack, said top part and said bottom part being connected to one another by an adhesive bond;

said top part (15) consists of a first one-piece folded blank, made of thin cardboard, having a rear pack panel (22) and a hinged lid (18); said hinged lid (18) having a rear lid panel (24), lid side tabs (26, 31), a top lid panel (28) and a front lid panel (29); said hinged lid (18) being hingedly connected to said rear pack panel (22) by a hinge line (25) between said rear pack panel (22) and said rear lid panel (24);

the bottom part consists of a second one-piece folded blank which is made of thinner foldable packaging material, and which is folded to have the form of a cup; said cup having a front wall (32), bottom tabs (37, 38) connected to one another to form a bottom wall, a side tab (35) connected to a connecting side strip (36) to form one side wall, and a second side wall (34); and the top part (15) contains a collar (19) comprising a collar front panel (20) and two collar side panels (21), the collar front panel (20) forming a front side of said top part (15) and being directly connected to said front wall (32) of said bottom part (16).

2. The pack as claimed in claim 1, wherein the bottom part (16) is connected by an adhesive bond to the top part (15) on an outer side of the top part along a connecting strip (17) which extends all around the pack.

3. A pack according to claim 1 or 2, wherein said top part (15) has side tabs (23) which adjoin said rear pack panel (22), wherein said first and second sidewalls (34, 35, 36) of the bottom part (16) are connected to said side tabs (23) of said top part (15), and wherein said collar side panels (21) abut inner sides of said side tabs (23) of said top part (15).

4. The pack as claimed in claim 1, wherein the bottom part (16) extends, at least in the region of a front side of the pack, up to a lower edge of the hinged lid (18) when the hinged lid is in the closed position, such that a lower edge of a front lid panel (29) is located directly opposite an upper edge of the bottom part (16).

5. The pack as claimed in claim 1, wherein the collar (19) is integrally connected to a blank for the top part (15) by tearable residual connections (40), such that the residual connections (40) are severable when the pack is opened.

6. The pack as claimed in claim 5, wherein lateral edge portions of the collar front panel are connected to lateral edge portions of an inner lid tab (39) by the residual connections (40), and wherein the inner lid tab (39) rests against the inner side of the front lid panel (29) when the top part (15) or hinged lid (18) is folded.

7. The pack as claimed in claim 5, wherein a folding tab (42) is attached to the inner lid tab (39) and rests against the inner side of the top lid panel (28) when the hinged lid (18) is folded; and wherein the folding tab (42) has contours which correspond to those of a cutout (43) in the collar front panel (20).

8. The pack as claimed in claim 5, wherein the collar is connected by the residual connections (40), which are arranged on both sides of the collar front panel (20), to respective lateral portions of an inner lid tab (39) of the hinged lid (18).

9. The pack as claimed in claim 5 or 8, wherein a folding tab (42) which is connected to an inner collar tab is formed in the region of the collar front panel (20) as a result of a curved punch cut (41) and rests against the inner side of a top lid panel (28), and wherein the punch cut (41) forms a cutout (43) the collar front panel (20), and the residual connections (40) are arranged on both sides of the cutout (43).

* * * * *